US008555840B2

(12) United States Patent
Choi

(10) Patent No.: US 8,555,840 B2
(45) Date of Patent: Oct. 15, 2013

(54) VARIABLE VALVE DEVICE

(75) Inventor: Myungsik Choi, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 195 days.

(21) Appl. No.: 13/172,458

(22) Filed: Jun. 29, 2011

(65) Prior Publication Data

US 2012/0137998 A1 Jun. 7, 2012

(30) Foreign Application Priority Data

Dec. 6, 2010 (KR) ..... 10-2010-0123446

(51) Int. Cl.
*F01L 1/18* (2006.01)

(52) U.S. Cl.
USPC ..... 123/90.39; 123/90.16; 123/90.43

(58) Field of Classification Search
USPC ..... 123/90.16, 90.39, 90.43, 90.41, 90.42, 123/90.44, 90.15
See application file for complete search history.

(56) References Cited

U.S. PATENT DOCUMENTS

| | | | | |
|---|---|---|---|---|
| 5,544,626 | A * | 8/1996 | Diggs et al. | 123/90.16 |
| 6,532,920 | B1 * | 3/2003 | Sweetnam et al. | 123/90.16 |
| 2009/0044771 | A1 | 2/2009 | Ezaki | |
| 2009/0107431 | A1 * | 4/2009 | Ezaki | 123/90.16 |

FOREIGN PATENT DOCUMENTS

| | | | |
|---|---|---|---|
| JP | 2005-233137 | A | 9/2005 |
| KR | 10-2008-0054207 | A | 6/2008 |
| KR | 10-0921045 | B1 | 10/2009 |

* cited by examiner

*Primary Examiner* — Zelalem Eshete
(74) *Attorney, Agent, or Firm* — Morgan, Lewis & Bockius LLP

(57) ABSTRACT

A variable valve device includes an outer body that a valve contacts at a side thereof, wherein an end of the other side is supported by a hydraulic lash adjuster, a bearing contacting a cam is formed in the center, and a stepped latching device insertion hole is formed in the center of the other side, an inner body that is located in the outer body, including a side portion that can rotate together with an end portion of the outer body around a valve stem shaft in the same axis, and the other portion is connected to a bearing shaft, a latching device that is inserted in the latching device insertion hole, and that selectively causes movement of the outer body depending on the movement of the inner body, and a lost motion spring that is formed outside of the outer body, and that provides an elastic force to enable the inner body to perform a lost motion.

14 Claims, 6 Drawing Sheets

VARIABLE VALVE DEVICE

CROSS-REFERENCE TO RELATED APPLICATION

This application claims priority to and the benefit of Korean Patent Application No. 10-2010-0123446 filed Dec. 6, 2010, the entire contents of which application is incorporated herein for all purposes by this reference.

BACKGROUND OF INVENTION

1. Field of Invention

The present invention relates to a variable valve device. More particularly, the present invention relates to a variable valve device that has a variable valve device for two valves operated, and that can easily sense a malfunction of the variable valve device.

2. Description of Related Art

Generally, an internal combustion engine generates power by burning fuel and air input into a combustion chamber. Intake valves are operated by a camshaft, and air is input into the combustion chamber when the intake valves are open.

Also, exhaust valves are operated by the camshaft, and the air is exhausted from the combustion chamber when the exhaust valves are open.

Optimum operation of the intake valves/exhaust valves is changed according to engine speed.

That is, an appropriate lift or an appropriate opening/closing time is changed according to the engine speed.

As described above, in order to realize an appropriate valve operation according to the engine speed, the cams driving the valves are multiply designed, or a variable valve lift (VVL) in which the valves can operate at different lifts according to the engine speed has been researched.

Also, cylinder deactivation (CDA) is a similar concept to the VVL. During CDA, some cylinders are deactivated when braking or running at a predetermined speed, and the fuel supply to the deactivated cylinders and the operation of the intake valves/exhaust valves are stopped.

The VVL apparatus and the CDA apparatus have common ground to adjust valve lifts.

As described above, the optimum intake air and intake speed are varied according to an engine condition. That is, rapid air speed is needed in a low load region, and on the other hand, much intake air is needed in a high load region.

To meet above demanded condition, variable valve lift (VVL) can be adopted in the intake valves.

In that case, the intake air moves fast in a low lift mode, and a high lift mode is applied in a high load region and much air is taken in, so performance, emissions, fuel consumption can be improved.

However, as shown in FIG. 8, which is a perspective view of the conventional VVL apparatus, if a cam 22 connected to a camshaft 20 presses a VVL apparatus 10, a valve 30 moves downward. The conventional VVL apparatus has used one VVL apparatus per valve, so two intake VVL apparatuses and two exhaust VVL apparatuses are needed per cylinder.

Because one VVL apparatus operates one valve, only when all the four valves operate normally does the VVL apparatus operate normally. In addition, sensing a malfunction is difficult during a malfunction of one valve, so considerable resources must be invested to sense the malfunction such that the cost is high. Further, the problems are accompanied if only one VVL apparatus per valve is equipped.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a variable valve device having advantages of easily sensing a malfunction of the variable valve device by installing one variable valve device for two valves at an intake valve side and an exhaust valve side, respectively.

Various aspects of the present invention provide for a variable valve device including an outer body that a valve contacts at a side thereof, wherein an end of the other side is supported by a hydraulic lash adjuster, a bearing contacting a cam is formed in the center, and a stepped latching device insertion hole is formed in the center of the other side, an inner body that is located in the outer body, including a side portion that can rotate together with an end portion of the outer body around a valve stem shaft in the same axis, and the other portion is connected to a bearing shaft, a latching device that is inserted in the latching device insertion hole, and that selectively causes movement of the outer body depending on movement of the inner body, and a lost motion spring that is formed outside of the outer body, and that provides an elastic force to enable the inner body to perform a lost motion.

The latching device according to various aspects of the present invention may include a latching pin that is inserted in the latching device insertion hole and is hollow at a portion thereof, a latching spring that is located at the hollow portion of the latching pin and provides the latching pin with elastic force, and a plate that is located at an end portion of the outer body and supports the latching spring.

The movement of the latching pin according to various aspects of the present invention may be limited by a step of the latching device insertion hole.

The lost motion spring according to various aspects of the present invention may have a straight line portion, and an installation groove of the lost motion spring formed at the outer body is formed in a step such that the lost motion spring is stably installed.

A protrusion according to various aspects of the present invention may be formed in the upper portion of the valve stem such that rotation of the valve stem is prevented.

The bearing according to various aspects of the present invention may be combined with the bearing shaft, and the bearing shaft is formed with a fixed diameter or is formed with two steps.

If the bearing shaft according to various aspects of the present invention is formed with a fixed diameter, the bearing shaft may tightly fit at a side of a bearing shaft insertion hole of the inner body, and if the bearing shaft is formed with two steps, the bearing shaft may tightly fit at both sides of the bearing shaft insertion hole of the inner body.

The height of the cam according to various aspects of the present invention may be controlled such that the difference between the valves is in the lamp section of the cam.

As described above, if two intake valves or two exhaust valves malfunction simultaneously when even one variable valve device malfunctions, the malfunction is easily sensed, and the cost can be reduced by installing one variable valve device per two valves.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
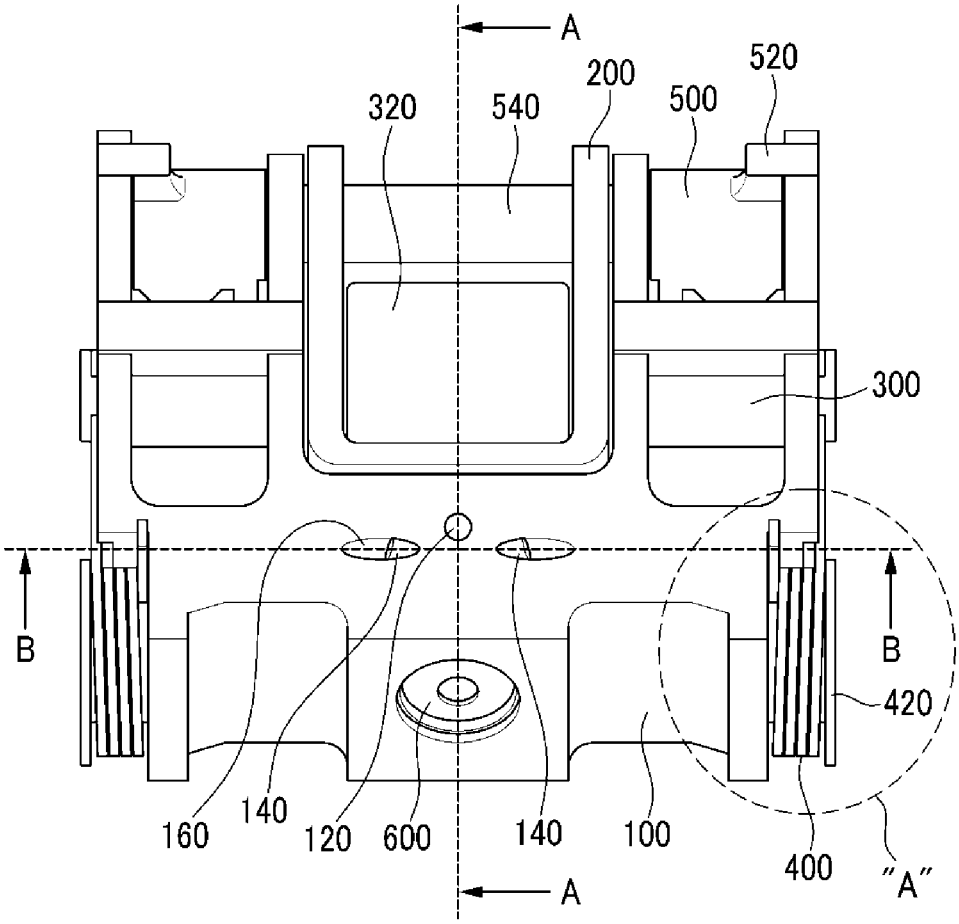
FIG. 1 is a top plan view of an exemplary CDA apparatus according to various embodiments of the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

A variable valve device according to various embodiments of the present invention includes an outer body 100 to which a valve stem 500 that is connected to a valve by a valve stem shaft 540 is installed at a side thereof, and hydraulic lash adjusters (HLA) 24 are respectively installed at both ends of the other side, wherein the outer body 100 is supported by the HLA 24, a bearing 320 contacting a cam is formed in the center thereof, a latching device insertion hole 165 is formed in a step in the center of the other side and can rotate around the valve stem shaft 540.

The variable valve device according to various embodiments of the present invention also includes an inner body 200 that is located in the outer body 100, an end thereof rotates around the valve stem shaft 540 together with an end of the outer body 100, and the other side is combined with a bearing shaft 300.

The variable valve device according to various embodiments of the present invention also includes a latching device 600 that is inserted in the latching device insertion hole 165, and selectively causes movement of the outer body 100 dependent on the movement of the inner body 200.

The variable valve device according to various embodiments of the present invention also includes a lost motion spring 400 that is respectively formed at both ends of the outer body 100, and supplies elastic force to enable the inner body 200 to perform a lost motion.

The lost motion spring 400 performs a function such that the inner body 200 is positioned at an original position by providing the inner body 200, which has moved downward during the CDA operation (in latching mode), with elastic force.

Bearing shaft insertion holes 135 and 265 and valve stem shaft insertion holes 155 and 255 are formed at the outer body 100 and the inner body 200 such that the bearing shaft 300 can be combined with the valve stem shaft 540.

The valve stem shaft 540 plays a role as an axle for the rotation of the inner body 200, and is engaged with the valve stem 500 such that the valve stem shaft 540 transfers force to a valve, and is engaged with the outer body 100 by laser welding.

The valve stem 500 contacting the top end portion of the valve transfers force to the valve and the HLA 24 supports the CDA device in an opposite position of the valve and functions as an oil passage, and to achieve this, an oil passage 151 is formed in the outer body 100.

The cross-section of the inner body 200 has a "[" shape, the valve stem shaft insertion hole 255 and the bearing shaft insertion hole 265 are respectively formed apart by a predetermined distance at both sides of the paralleled portion in the inner body 200, and a latching device insertion hole 235 is formed at a portion that is vertically intersected with a parallel portion.

The latching device 600 is inserted into the latching device insertion hole 165 of the outer body 100 and the latching device insertion hole 235 of the inner body 200 such that movement of the inner body 200 is subject to movement of the outer body 100. The latching device 600 includes a latching pin 620 that is partially hollow, a latching spring 640 that is located at the hollow portion and provides the latching pin 620 with elastic force, and a plate 660 that is located at the end of the outer body 100 and supports the latching spring 640.

The latching pin 620 is formed in a step such that movement of the latching pin 620 is restricted by the step of the latching device insertion hole 165 of the outer body 100.

Figure 4:
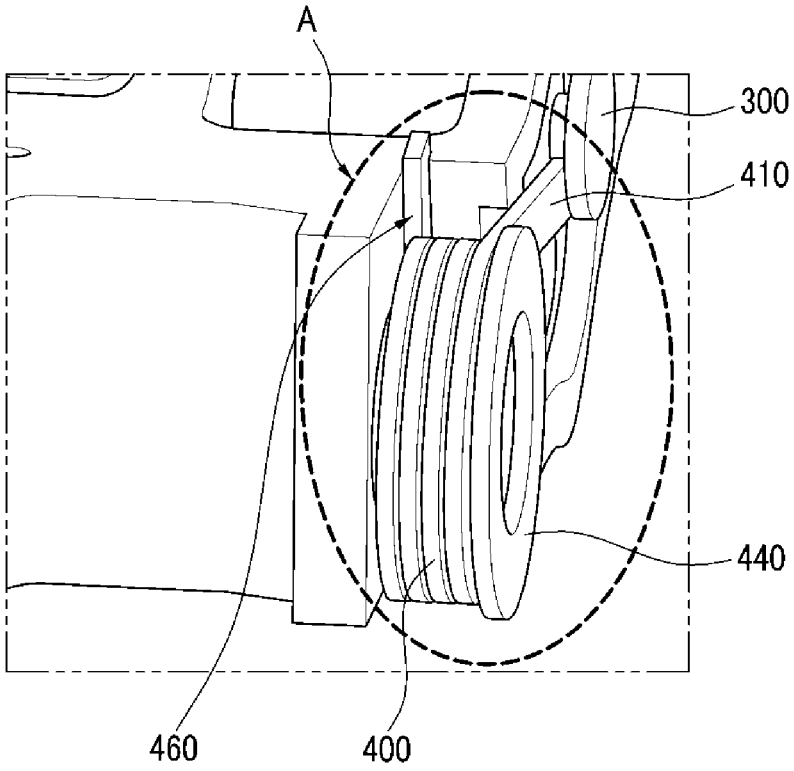
FIG. 4 is a partially perspective view of the CDA apparatus with a lost motion spring equipped according to various embodiments of the present invention.
Figure 5:
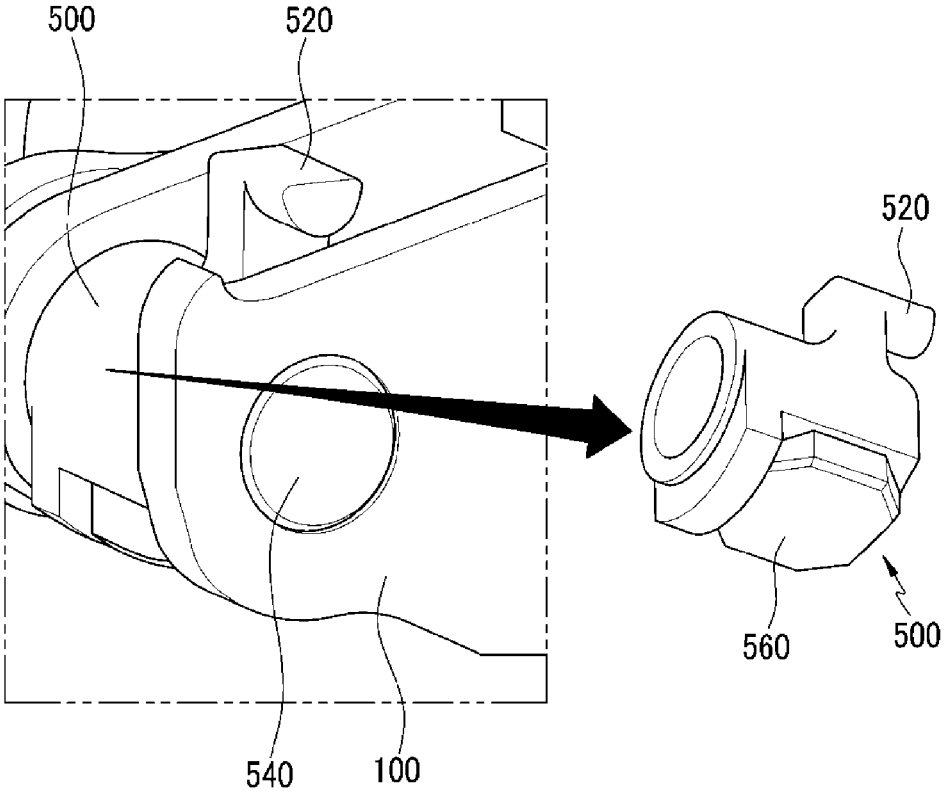
FIG. 5 is a perspective view of an exemplary valve stem with an enlarged detaile of the valve stem.
Figure 6:
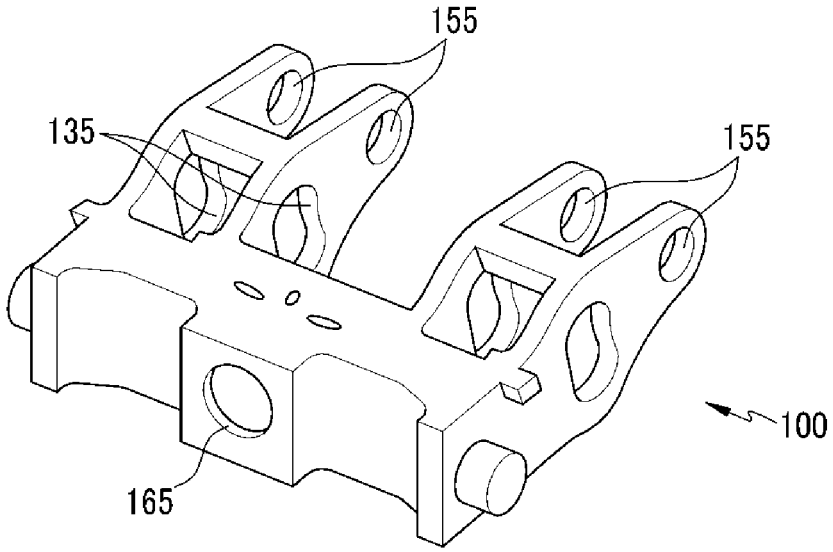
FIG. 6 is a perspective view of an outer body according to various embodiments of the present invention.
Figure 7:
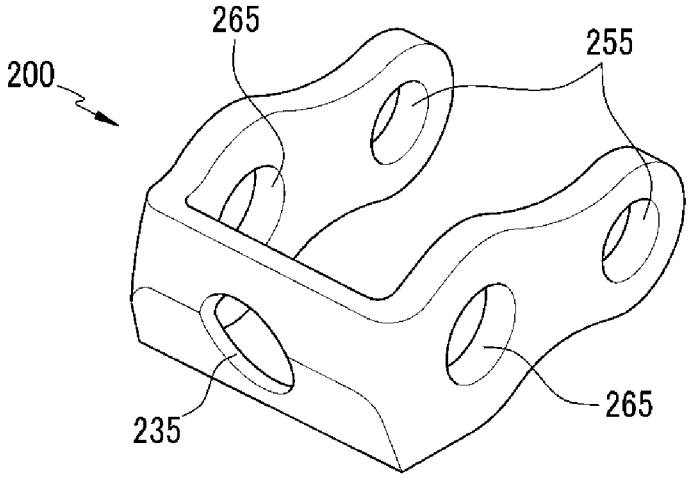
FIG. 7 is a perspective view of an inner body according to various embodiments of the present invention.
Figure 8:
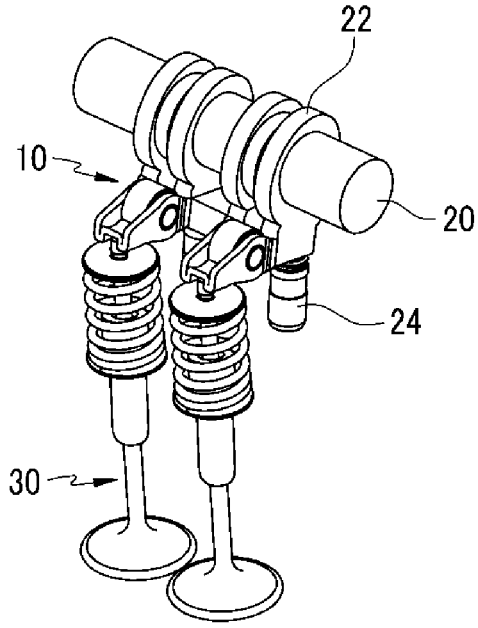
FIG. 8 is a perspective view of a conventional VVL apparatus.

FIG. 4 is a partially expanded view of a portion "A" of FIG. 1. The lost motion spring 400 has been improved in various embodiments of the present invention such that a receiving groove 460 to which the conventional lost motion spring 400 is located is formed in a step such that the lost motion spring 400 does not have a curved line portion and has only a straight line portion 410. Therefor, the device is easily manufactured.

That is, the conventional lost motion spring is protruded outward such that a portion from the part draped at the bearing shaft 300 of the lost motion spring to a spring guide 440 is somewhat rounded. Therefor, to prepare the spring is somewhat difficult, but the present invention has solved the problem that much force cannot be supported by the curved line portion.

The lost motion spring 400 can therefor be prevented from deviating by the spring guide 440.

Also, a protrusion 520 is formed at the upper portion of the valve stem 500 contacting the valve in various embodiments of the present invention such that rotation of the valve stem 500 can be prevented, and assembling a sliding surface 560 of the valve stem 500 in order to face the valve can be easy.

The bearing 320 directly contacting the cam is engaged with the bearing shaft 300, and the bearing shaft 300 can be formed without steps with one diameter or can be formed with two steps. If the bearing shaft 300 is formed with a constant diameter, the bearing shaft insertion hole 265 of the inner body 200 tightly fits at only one side of the bearing shaft insertion hole 265 of the inner body 200, and if the bearing shaft 300 is formed with two steps, the bearing shaft 300 fits so tightly at both sides of the bearing shaft insertion hole 265 of the inner body 200 that a deviation of the bearing 320 due to a deviation of the bearing shaft 300 can be prevented.

Various embodiments of the present invention relates to a CDA device in which two hydraulic lash adjusters 24 drive two valves, i.e. an intake valve and an exhaust valve. A difference of the height between the two valves must be in a ramp section of the cam in order to drive the two valves.

To achieve this, the height of the cams must be higher than that of the conventional cams.

The ramp section means a section where the valves 30 can be smoothly opened/closed, and results from manufacturing tolerance while manufacturing the valves 30.

Hereinafter, the operation process according to various embodiments of the present invention will be described.

Figure 2:
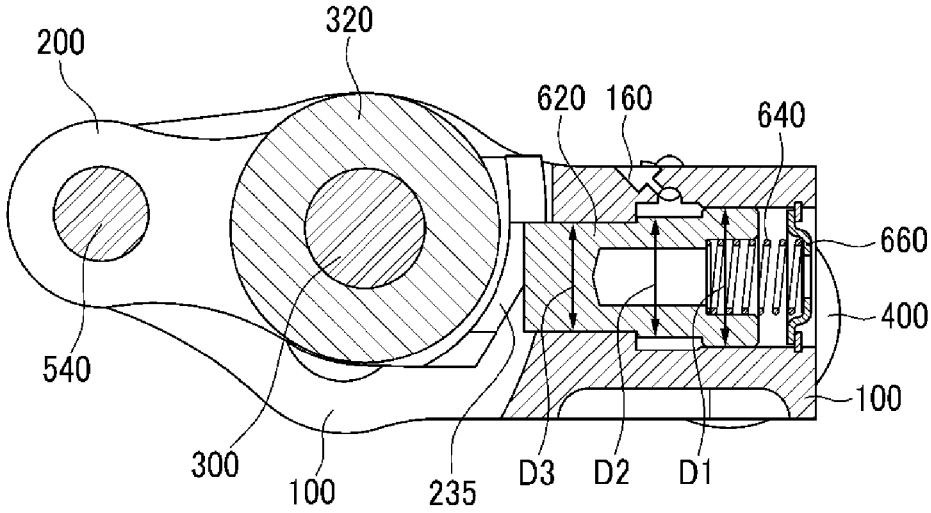
FIG. 2 is a cross-sectional view along the line A-A of FIG. 1.

First, FIG. 2 is a cross-sectional view of the CDA device in a latching mode according to various embodiments of the present invention.

The CDA device according to various embodiments of the present invention can have the movement of the inner body 200 be dependent on the movement of the outer body 100 by selective oil supply.

Two HLAs 24 per CDA device are used in various embodiments of the present invention. If there is no problem in a layout of an engine, only one HLA 24 can be used.

An unlatching mode (CDA on) will be described first.

Figure 3:
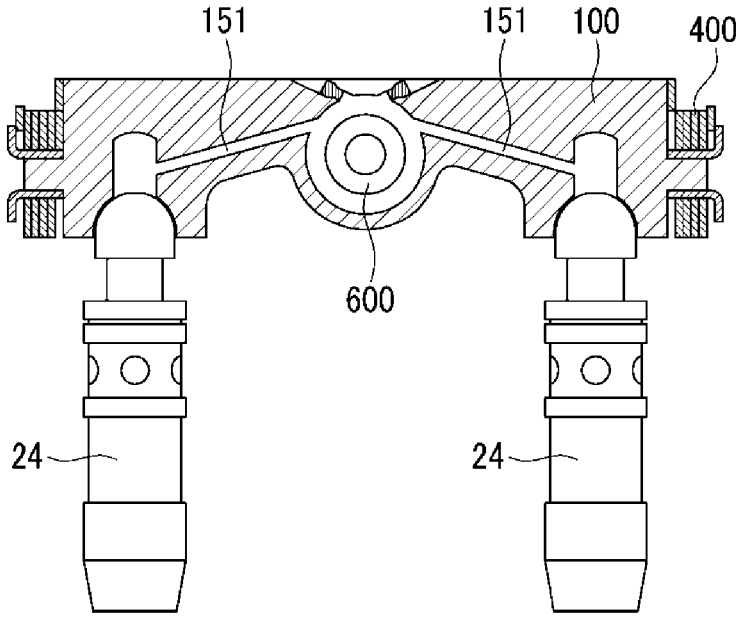
FIG. 3 is a B-B cross-sectional view along the line B-B of FIG. 1.

FIG. 2 is a horizontal cross-sectional view of the variable valve device in a latching mode according to various embodiments of the present invention, and FIG. 3 is a vertical cross-sectional view of the variable valve device. As shown in the FIG. 2 and FIG. 3, when an oil control valve (OCV) is opened, oil from a cylinder head oil gallery flows in through an oil injection hole 120, and the inflowed oil exerts pressure on the latching pin 620 of the CDA device and pushes the latching pin 620 outward against the latching spring 640. By this operation, an unlatching state, in which the inner body 200 and the outer body 100 can independently move up and down, is achieved.

By the unlatching mode, although the cam presses the inner body 200, the valve maintains a closed state.

A sealing member 140 is formed such that the supplied oil does not flow out through an oil outlet 160.

Also, the latching pin 620 is formed with two steps, and the end of the latching pin 620 contacting the inner body 200 is formed with a similar size to the inner diameter D3 of the latching device insertion hole 235, but there a step is formed with a larger size D2 than the diameter D3 at the further inside part.

In the unlatching mode, the descending of the inner body 200 does not contribute to valve lift even though the cam contacts the bearing 320 and presses the inner body 200, so the CDA mode is fulfilled.

Hereinafter, the latching mode (CDA off) will be described.

The oil control valve is closed in the latching mode, such that the oil from the cylinder head oil gallery is prevented from flowing into the latching pin 620 of the CDA device. In this way, the latching mode is fulfilled by the latching spring 640, so the valves operate when the cam presses the inner body 200.

As one CDA device activates two valves in the above way, the CDA device normally operates when the intake/exhaust valves normally operate.

For convenience in explanation and accurate definition in the appended claims, the terms upper, inside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve device comprising:

an outer body including a valve-contacting side and an end of another side supported by at least two hydraulic lash adjusters, a bearing contacting a cam formed in the center, and a stepped latching device insertion hole formed in the center of the another side;

an inner body that is located within the outer body including a side portion that can rotate together with an end portion of the outer body around a valve stem shaft along a mutual axis, and the other portion is connected to a bearing shaft to which the bearing is mounted;

a latching device that is inserted in the latching device insertion hole and selectively causes movement of the outer body to depend on movement of the inner body; and a lost motion spring that is formed outside of the outer body, and that supplies elastic force to enable the inner body to perform a lost motion, wherein the at least two hydraulic lash adjusters are fluid-connected to the latching device, and wherein at least two valves contact on the valve-contacting side of the outer body.

2. The variable valve device of claim 1, wherein the latching device comprises of a latching pin that is inserted in the latching device insertion hole and is hollow at a portion thereof, a latching spring that is located at the hollow portion of the latching pin and provides the latching pin with elastic force, and a plate that is located at an end portion of the outer body and supports the latching spring.

3. The variable valve device of claim 2, wherein the movement of the latching pin is limited by a step of the latching device insertion hole.

4. The variable valve device of claim 1, wherein the lost motion spring has a straight portion, and an installation groove of the lost motion spring formed at the outer body is formed in a step such that the lost motion spring is stably installed.

5. The variable valve device of claim 1, wherein a protrusion is formed in the upper portion of a valve stem such that rotation of the valve stem is prevented.

6. The variable valve device of claim 1, wherein the bearing is combined with the bearing shaft, and the bearing shaft is formed with a fixed diameter or is formed with two steps.

7. The variable valve device of claim 6, wherein if the bearing shaft is formed with a fixed diameter, the bearing shaft tightly fits at a side of the bearing shaft insertion hole of the inner body, and if the bearing shaft is formed in two steps, the bearing shaft tightly fits at both sides of the bearing shaft insertion hole of the inner body.

8. The variable valve device of claim 1, wherein the height of the cam is controlled such that the difference between the valves is in the ramp section of the cam.

9. The variable valve device of claim 2, wherein the height of the cam is controlled such that the difference between the valves is in the ramp section of the cam.

10. The variable valve device of claim 3, wherein the height of the cam is controlled such that the difference between the valves is in the ramp section of the cam.

11. The variable valve device of claim 4, wherein the height of the cam is controlled such that the difference between the valves is in the ramp section of the cam.

12. The variable valve device of claim 5, wherein the height of the cam is controlled such that the difference between the valves is in the ramp section of the cam.

13. The variable valve device of claim 6, wherein the height of the cam is controlled such that the difference between the valves is in the ramp section of the cam.

14. The variable valve device of claim 7, wherein the height of the cam is controlled such that the difference between the valves is in the ramp section of the cam.

* * * * *